US007663297B2

(12) United States Patent
Ryu et al.

(10) Patent No.: US 7,663,297 B2
(45) Date of Patent: Feb. 16, 2010

(54) LIGHT EMISSION DEVICE AND DISPLAY DEVICE

(75) Inventors: Kyung-Sun Ryu, Yongin-si (KR); Sang-Jin Lee, Yongin-si (KR); Su-Joung Kang, Yongin-si (KR); Jin-Ho Lee, Yongin-si (KR); Kyu-Won Jung, Yongin-si (KR); Jong-Hoon Shin, Yongin-si (KR); Pil-Goo Jun, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 241 days.

(21) Appl. No.: 11/690,083

(22) Filed: Mar. 22, 2007

(65) Prior Publication Data

US 2007/0267961 A1 Nov. 22, 2007

(30) Foreign Application Priority Data

May 19, 2006 (KR) ..... 10-2006-0045223
Jun. 15, 2006 (KR) ..... 10-2006-0054000
Jun. 15, 2006 (KR) ..... 10-2006-0054001
Jun. 16, 2006 (KR) ..... 10-2006-0054455

(51) Int. Cl.
*H01J 1/62* (2006.01)

(52) U.S. Cl. ..... 313/495; 313/496; 313/497

(58) Field of Classification Search ..... 313/495, 313/496, 497, 309–310; 445/23–25
See application file for complete search history.

(56) References Cited

U.S. PATENT DOCUMENTS 5,672,933 A 9/1997 Wilson et al.
5,798,604 A 8/1998 Duboc, Jr. et al.
6,404,124 B1 * 6/2002 Sakemura et al. ..... 313/495

(Continued)

FOREIGN PATENT DOCUMENTS

CN 1722352 A 1/2006

(Continued)

OTHER PUBLICATIONS

Patent Abstracts of Japan for Publication No. 2005-222932; dated Aug. 18, 2005 in the name of Koji Yamazaki.

(Continued)

*Primary Examiner*—Joseph L Williams
*Assistant Examiner*—Brenitra M Lee
(74) *Attorney, Agent, or Firm*—Christie, Parker & Hale, LLP

(57) ABSTRACT

A light emission device and a display device using the light emission device as a light source are provided. The light emission device includes a vacuum envelope formed by first and second substrates and a sealing member, first electrodes formed on the first substrate in a first direction, an insulating layer formed on the first substrate and covering the first electrodes, second electrodes formed on the insulating layer in a second direction crossing the first direction, electron emission regions electrically connected to the first electrodes or the second electrodes, a resistive layer for covering a first surface of the insulating layer, the first surface facing the second substrate, a phosphor layer formed on the second substrate, and an anode electrode formed on the phosphor layer.

22 Claims, 7 Drawing Sheets

U.S. PATENT DOCUMENTS

| | | | | |
|---|---|---|---|---|
| 6,414,421 | B1 | 7/2002 | Imura et al. | |
| 2003/0122197 | A1 | 7/2003 | Hwang et al. | |
| 2004/0171470 | A1* | 9/2004 | Hayama | 493/480 |
| 2005/0040752 | A1 | 2/2005 | Hwang | |
| 2005/0110394 | A1* | 5/2005 | Lee et al. | 313/497 |
| 2005/0264156 | A1* | 12/2005 | Hwang | 313/309 |
| 2006/0125370 | A1* | 6/2006 | Nishimura et al. | 313/310 |
| 2006/0170008 | A1 | 8/2006 | Konishi | |
| 2006/0170329 | A1* | 8/2006 | Tojo et al. | 313/495 |
| 2006/0238108 | A1* | 10/2006 | Hwang | 313/496 |
| 2006/0267474 | A1* | 11/2006 | Imamura et al. | 313/485 |
| 2007/0176533 | A1* | 8/2007 | Dean et al. | 313/497 |

FOREIGN PATENT DOCUMENTS

| | | |
|---|---|---|
| FR | 2 785 718 | 5/2000 |
| FR | 2 828 956 | 2/2003 |
| JP | 2000-21340 | 1/2000 |
| JP | 2000-251776 | 9/2000 |
| JP | 2001-229805 | 8/2001 |
| JP | 2001-236879 | 8/2001 |
| JP | 2005-222932 | 8/2005 |
| JP | 2005-275105 | 10/2005 |
| KR | 10-2001-0011555 | 2/2001 |
| KR | 2002-0009067 | 2/2002 |
| KR | 10-2002-0029564 | 4/2002 |
| KR | 2003-0046743 | 6/2003 |
| KR | 2003-0063529 | 7/2003 |
| KR | 10-2004-0067290 | 7/2004 |
| KR | 10-2005-0078330 | 8/2005 |
| KR | 10-2005-0079340 | 8/2005 |
| KR | 10-2005-0123401 | 12/2005 |
| KR | 10-2006-0007582 | 1/2006 |
| WO | WO 2004/081965 A1 | 9/2004 |

OTHER PUBLICATIONS

Patent Abstracts of Japan for Publication No. 2005-275105; dated Oct. 6, 2005 in the name of Koichi Aizawa, et al.
Korean Patent Abstracts for Publication No. 1020010011555; dated Feb. 15, 2001 in the name of Yang Un Na.
Korean Patent Abstracts for Publication No. 1020020029564; dated Apr. 19, 2002 in the name of Seong Hak Mun.
Patent Abstracts of Japan for Publication No. 2000-251776; dated Sep. 14, 2000 in the name of Yasuhiro Hamamoto, et al.
Patent Abstracts of Japan for Publication No. 2001-236879; dated Aug. 31, 2001 in the name of Kou Ri, et al.
Korean Patent Abstract, Publication No. 1020060007582 A; dated Jan. 26, 2006 in the name of Jae Woo Bae, et al.
Patent Abstracts of Japan, Publication No. 2000-021340; Date of Publication: Jan. 21, 2000; in the name of Shigeo Ito et al.
Patent Abstracts of Japan, Publication No. 2001-229805; Date of Publication: Aug. 24, 2001; in the name of Mitsuru Tanaka et al.
Korean Patent Abstracts, Publication No. 1020020009067 A; Date of Publication: Feb. 1, 2002; in the name of Jae Hun Jung.
Korean Patent Abstracts, Publication No. 1020030046743 A; Date of Publication: Jun. 18, 2003; in the name of Jun Hui Choi.
Korean Patent Abstracts, Publication No. 1020030063529 A; Date of Publication: Jul. 31, 2003; in the name of Hang U Lee, et al.
Korean Patent Abstracts, Publication No. 1020040067290 A; Date of Publication: Jul. 30, 2004; in the name of Gi Seong Chae, et al.
Korean Patent Abstracts, Publication No. 1020050078330 A; Date of Publication: Aug. 5, 2005; in the name of Cheol Hyeon Chang.
Korean Patent Abstracts, Publication No. 1020050079340 A; Date of Publication: Aug. 10, 2005; in the name of Hang Woo Lee, et al.
Korean Patent Abstracts, Publication No. 1020050123401 A; Date of Publication: Dec. 29, 2005; in the name of Seong Kwon Kim.
European Search Report dated Sep. 28, 2007 for corresponding European Patent Application No. 07108191.3.

* cited by examiner

LIGHT EMISSION DEVICE AND DISPLAY DEVICE

CROSS-REFERENCES TO RELATED APPLICATIONS

This application claims priority to and the benefit of Korean Patent Application Nos. 10-2006-0045223, 10-2006-0054000, 10-2006-0054001 and 10-2006-0054455 filed in the Korean Intellectual Property Office on May 19, 2006, Jun. 15, 2006, Jun. 15, 2006, and Jun. 16, 2006, respectively, the entire contents of which are incorporated herein by reference.

BACKGROUND OF THE INVENTION

1. Field of the Invention

The present invention relates to a display device, and more particularly, to a light emission device emitting light using electron emission regions and a phosphor layer, and a display device using the light emission device as a light source.

2. Description of Related Art

A light emission device that includes first and second substrates facing each other with a gap therebetween, a plurality of electron emission regions provided on the first substrate, and a phosphor layer and an anode electrode provided on the second substrate is well known. The light emission device has a simplified optical member and lower power consumption than both a cold cathode fluorescent lamp (CCFL) type light emission device and a light emitting diode (LED) type light emission device.

The first and second substrates are sealed together at their peripheries using a sealing member to form a vacuum envelope. In the light emission device, electrons emitted from the electron emission regions are accelerated toward the phosphor layer by an anode voltage applied to the anode electrode, and excite the phosphor layer to emit visible light. The luminance of a light emission surface is proportional to the anode voltage.

The light emission device can be used as a light source in a display device including a non-self emissive type display panel. However, in the light emission device, when a high voltage is applied to the anode electrode to enhance the light emission intensity, arcing is generated in the vacuum envelope due to gas impurity and the charging of a non-conductor surface in the vacuum envelope. The arcing may damage the internal structure. Therefore, it is difficult to increase the anode voltage, and thus it is difficult to increase the luminance to a desired level.

In addition, the light emission device is driven to maintain a predetermined brightness over the entire light emission surface when the display device is driven. Therefore, it is difficult to improve the dynamic contrast and display quality of the screen to a sufficient level.

SUMMARY OF THE INVENTION

In one embodiment, the present invention provides a light emission device that enhances a light emission intensity by suppressing the generation of arcing in a vacuum envelope and increasing an anode voltage and display device using the light emission device as a light source.

In one embodiment, the present invention is a light emission device that independently controls light intensities of a plurality of divided regions of a light emission surface and a display device that enhances the dynamic contrast of the screen by using the light emission device as a light source.

According to an exemplary embodiment of the present invention, a light emission device includes: a vacuum envelope formed by first and second substrates and a sealing member; first electrodes formed on the first substrate in a first direction; an insulating layer formed on the first substrate and covering the first electrodes; second electrodes formed on a portion of the insulating layer in a second direction crossing the first direction; electron emission regions electrically connected to one of the first and second electrodes; a resistive layer for covering a first surface of the insulating layer, the first surface facing the second substrate; a phosphor layer formed on the second substrate; and an anode electrode formed on the phosphor layer.

The resistive layer may be formed on a first portion of the first surface of the insulating layer. The first portion is not covered by (excludes) the second electrodes. Alternatively, the resistive layer fully covers the first surface of the insulating layer.

The light emission device may further include a conductive layer formed on an edge of the insulating layer and spaced away from the second electrodes. The resistive layer may be formed on a first portion of the insulating layer, the first portion of the insulating layer facing the second substrate and not covered (excluding) with the second electrodes and the conductive layer.

The light emission device may further include an additional resistive layer formed on an inner surface of the sealing member.

The resistive layer may have a specific resistance within the range of about $10^6$-$10^{12}$ Ωcm.

The resistive layer may be formed above the insulating layer and the second electrodes with an additional insulating layer disposed therebetween and openings through which electron beams pass are formed through the additional insulating layer.

The first and second substrates may be spaced apart from each other by a distance within the range of about 5-10 mm and the light emission device further may further includes an anode voltage applying portion applying a DC voltage within the range of 10-15 kV to the anode electrode.

According to another exemplary embodiment of the present invention, there is provided a display device including: a display panel for displaying an image; a light emission device for emitting light toward the display panel, wherein the light emission device comprises: a vacuum envelope formed by first and second substrates and a sealing member; an electron emission unit including first electrodes formed on the first substrate in a first direction, an insulating layer formed on the first substrate and covering the first electrodes, second electrodes formed on the insulating layer in a second direction crossing the first direction, electron emission regions electrically connected to one of the first and second electrodes, and a resistive layer for covering a first surface of the insulating layer, the first surface facing the second substrate; and a light emission unit including a phosphor layer formed on the second substrate and an anode electrode formed on the phosphor layer.

The display panel includes first pixels and the light emission device includes second pixels. The number of second pixels may be less than that of the first pixels. The display panel may be a liquid crystal display panel.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF INVENTION

The present invention will now be described more fully with reference to the accompanying drawings, in which exemplary embodiments of the invention are shown. The invention may, however, be embodied in many different forms and should not be construed as being limited to the embodiments set forth herein.

Figure 1:
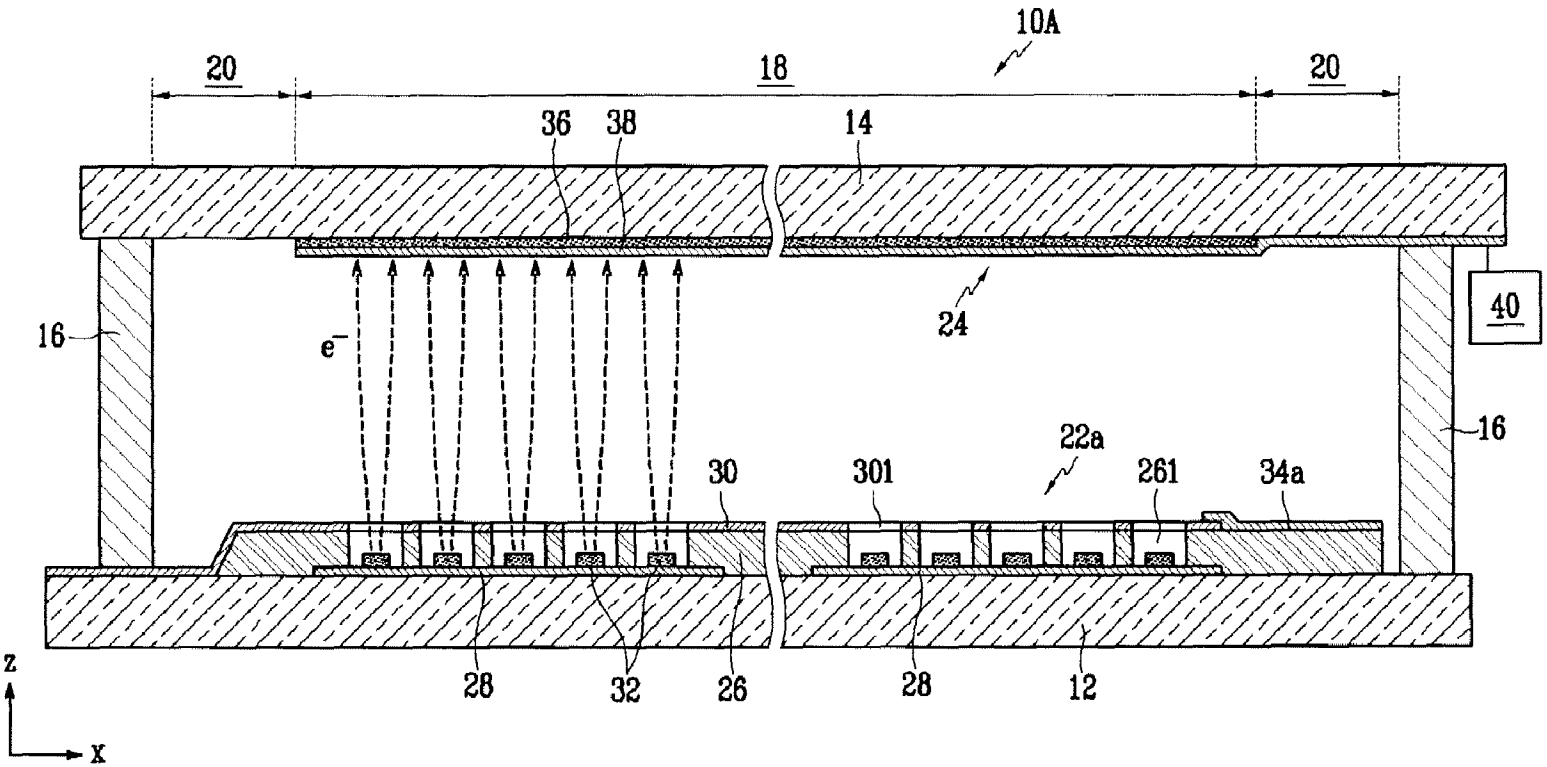
FIG. 1 is a sectional view of a light emission device according to an embodiment of the present invention.

FIG. 1 is a sectional view of a light emission device according to an embodiment of the present invention. Referring to FIG. 1, a light emission device 10A includes first and second substrates 12 and 14 facing each other at a predetermined interval. A sealing member 16 is provided at each of the peripheries of the first and second substrates 12 and 14 to seal them together and thus form a sealed envelope. In one embodiment, the interior of the sealed envelope is kept to a degree of vacuum of about $10^{-6}$ Torr.

Each of the first and second substrates 12 and 14 has an active area 18 emitting visible light and an inactive area 20 surrounding the active area 18 within an area surrounded by the seal members 16. An electron emission unit 22*a* for emitting electrons is provided on the active area 18 of the first substrate 12 and a light emission unit 24 for emitting the visible light is provided on the active area 18 of the second substrate 14.

Figure 2:
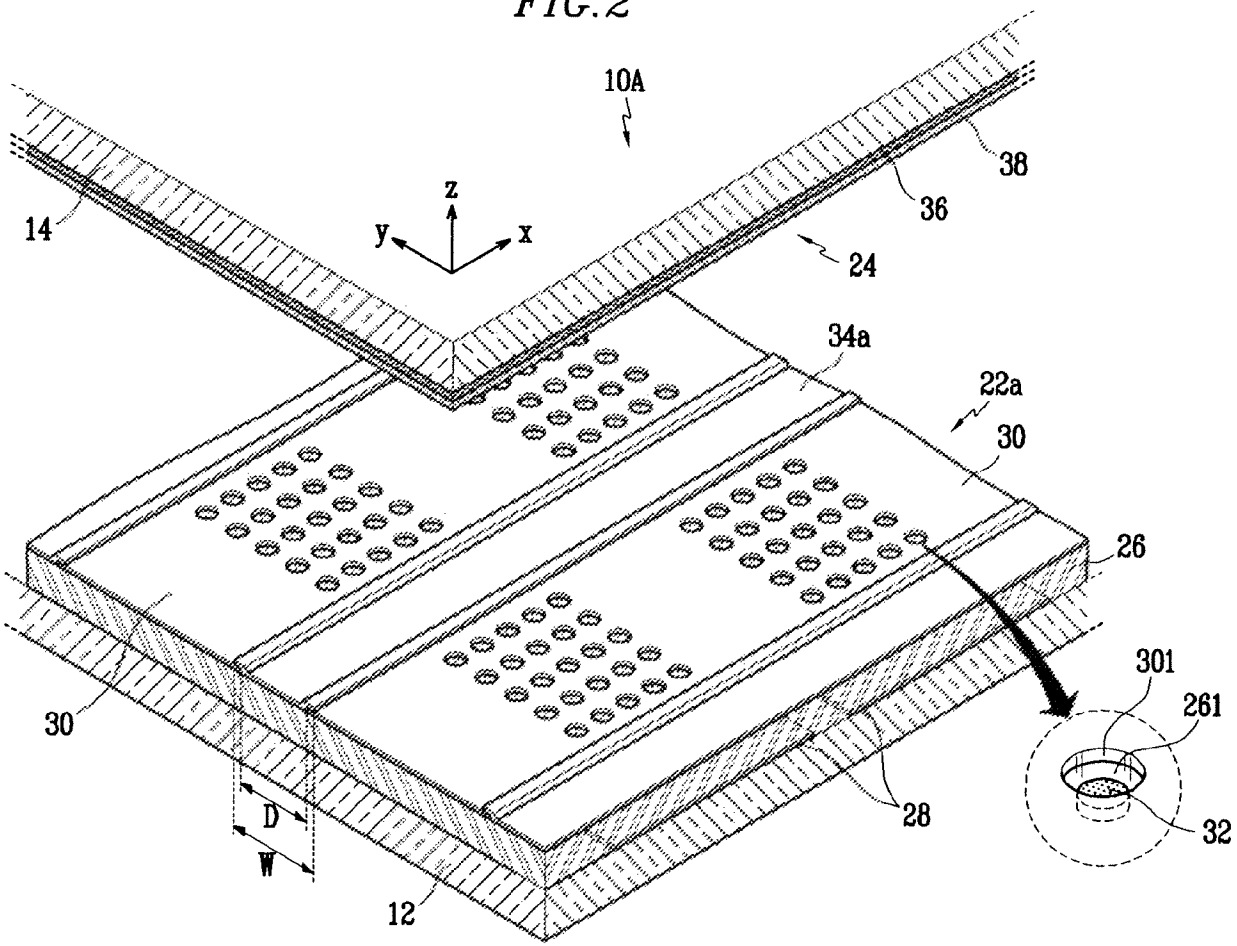
FIG. 2 is a partial exploded perspective view of an active area of the light emission device of FIG. 1.

FIG. 2 is a partial exploded perspective view of an active area 18 of the light emission device of FIG. 1. Referring to FIGS. 1 and 2, the electron emission unit 22*a* includes first electrodes 28 and second electrodes 30 insulated from each other by an insulating layer 26 and electron emission regions 32 electrically connected to one of the first and second electrodes 28 and 30. The insulating layer 26 may be formed on an entire area of the active area 18 and an entire area of the inactive area 20, or a part of the inactive area 20 as shown in FIG. 1.

When the electron emission regions 32 are formed on the first electrodes 28, the first electrodes 28 are cathode electrodes applying a current to the electron emission regions 32 and the second electrodes 30 are gate electrodes inducing the electron emission by forming the electric field around the electrode emission regions 32 according to a voltage difference between the cathode and gate electrodes. On the contrary when the electron emission regions 32 are formed on the second electrodes 30, the second electrodes 30 are cathode electrodes and the first electrodes 28 are gate electrodes.

Among the first and second electrodes 28 and 30, the electrodes arranged along rows of the light emission device 10A function as scan electrodes and the electrodes arranged along columns function as data electrodes.

FIGS. 1 and 2 illustrate an example where the electron emission regions 32 are formed on the first electrodes 28, the first electrodes 28 are arranged along the columns (in a direction of a y-axis in FIGS. 1 and 2) of the light emission device 10A, and the second electrodes 30 are arranged along the rows (in a direction of an x-axis in FIGS. 1 and 2) of the light emission device 10A. However, the arrangements of the electron emission regions 32 and the first and second electrodes 28 and 30 are not limited to the above example.

Openings 261 and 301 are formed through the insulating layer 26 and the second electrode 30 at crossed regions of the first and second electrodes 28 and 30 to partly expose the surface of the first electrodes 28. The electron emission regions 32 are formed on the first electrodes 28 through the openings 261 of the insulating layer 26.

The electron emission regions 32 are formed of a material emitting electrons when an electric field is applied thereto under a vacuum atmosphere, such as a carbon-based material or a nanometer-sized material. The electron emission regions 32 can be formed of carbon nanotubes, graphite, graphite nanofibers, diamonds, diamond-like carbon, $C_{60}$, silicon nanowires or a combination thereof. The electron emission regions 32 can be formed through a screen-printing process, a direct growth, a chemical vapor deposition, or a sputtering process. Alternatively, the electron emission regions can be formed in a tip structure formed of a Mo-based or Si-based material.

A resistive layer 34*a* is formed on a portion of the insulating layer 26, which is not covered by the second electrodes 30 so that a surface of the insulating layer 26 cannot be exposed to the vacuum environment. The resistive layer 34*a* has specific resistance lower than that of the insulating layer 26. In one embodiment, the resistive layer 34*a* has specific resistance within the range of about $10^6$-$10^{12}$ Ωcm. Since the resistive layer 34*a* is a high resistive body, no electric current is applied between the second electrodes 30 through the resistive layer 34*a*.

The resistive layer 34*a* is formed between the second electrodes 30 at the active area 18 of the first substrate 12 and formed having a predetermined width to surround the edge of the active area 18 at the inactive area 20 of the first substrate. As shown in FIG. 2, the resistive layer 34*a* at the active area 18 has a width W greater than a distance D between the second electrodes 30 to cover a part of a top surface of each second electrode 30 as well as the exposed surface of the insulating layer 26.

The resistive layer 34*a* may be formed of amorphous silicon doped with n-type or p-type ions. Alternatively, the resistive layer 34*a* may be formed of a mixture of insulation material and conductive material. In this case, the conductive material may be selected from the group of metal nitride such as aluminum nitride (AlN), metal oxide such as $Cr_2O_3$, a carbon-based conductive material such as graphite, or a mixture thereof. The resistive layer 34*a* may be formed through a screen-printing process or a plasma-enhanced chemical vapor deposition.

The resistive layer 34*a* has an electric charge preventing function by which electric charges are not accumulated on a surface thereof. The resistive layer 34*a* may be grounded through an external circuit (not shown) or applied with a negative DC voltage.

One overlapping region of the first and second electrodes 28 and 30 may correspond to one pixel region of the light emission device 10A. Alternatively, two or more overlapping regions of the first and second electrodes 28 and 30 may correspond to one pixel region of the light emission device 1A. In this case, two or more first electrodes 28 and/or two or more second electrodes 30 that are placed in one pixel region are electrically connected to each other to receive a common driving voltage.

The light emission unit 24 includes a phosphor layer 36 and an anode electrode 38 formed on the phosphor layer 36. The phosphor layer 36 may be formed by a white phosphor layer or a combination of red, green and blue phosphor layers. When the phosphor layer 36 is the white phosphor layer, the phosphor layer may be formed at the entire active area 18 of the second substrate 14, or divided in a plurality of sections each corresponding to each pixel region. The red, green and blue phosphor layers are formed in a predetermined pattern in each pixel region. In FIG. 2, an example where the white phosphor layer is placed at the entire active area 18 of the second substrate 14 is shown.

The anode electrode 38 may be formed by a metal such as Aluminum and cover the phosphor layer 36. The anode electrode 38 is an acceleration electrode that receives a high voltage to maintain the phosphor layer 38 at a high electric potential state. The anode electrode 38 functions to enhance the luminance by reflecting the visible light, which is emitted from the phosphor layers 36 to the first substrate 12, toward the second substrate 14.

Disposed between the first and second substrates 12 and 14 are spacers (not shown) for uniformly maintaining a gap between the first and second substrates 12 and 14 against the outer force.

The above-described light emission device 10A is driven by applying drive voltages to the first and second electrodes 28 and 30 and applying thousands volt of a positive high DC voltage (e.g., several thousand volts) to the anode electrode 38.

Then, an electric field is formed around the electron emission regions 32 at pixel regions where a voltage difference between the first and second electrodes 28 and 30 is higher than a threshold value, thereby emitting electrons from the electron emission regions 32. The emitted electrons are accelerated by the high voltage applied to the anode electrode 38 to collide with the corresponding phosphor layer 38, thereby exciting the phosphor layer 38. The light emission intensity of the phosphor layer 38 at each pixel corresponds to an electron emission amount of the corresponding pixel.

In the above-described driving process, since the exposed surface of the insulating layer 26, which is not covered by the second electrodes 30, is covered by the resistive layer 34*a*, the exposed surface of the insulating layer 26 is not electrically charged. Therefore, the arcing due to the electric charge can be minimized.

Since a relatively high voltage, for example, above 10 kv can be applied to the anode electrode 38 as compared with the convention field emission type backlight unit, the light emission intensity can be enhanced without damaging the internal structure of the light emission device.

In one embodiment, the gap between the first and second substrates 12 and 14 may be within the range of, for example, 5-20 mm that is greater than that of a conventional field emission type backlight unit. The anode electrode 38 receives a high voltage above 10 kV, preferably, about 10-15 kV, through an anode voltage applying unit 40, shown in FIG. 1. Accordingly, the inventive light emission device 10A realizes a luminance above 10,000 cd/m$^2$ at a central portion of the active area 18.

Figure 3:
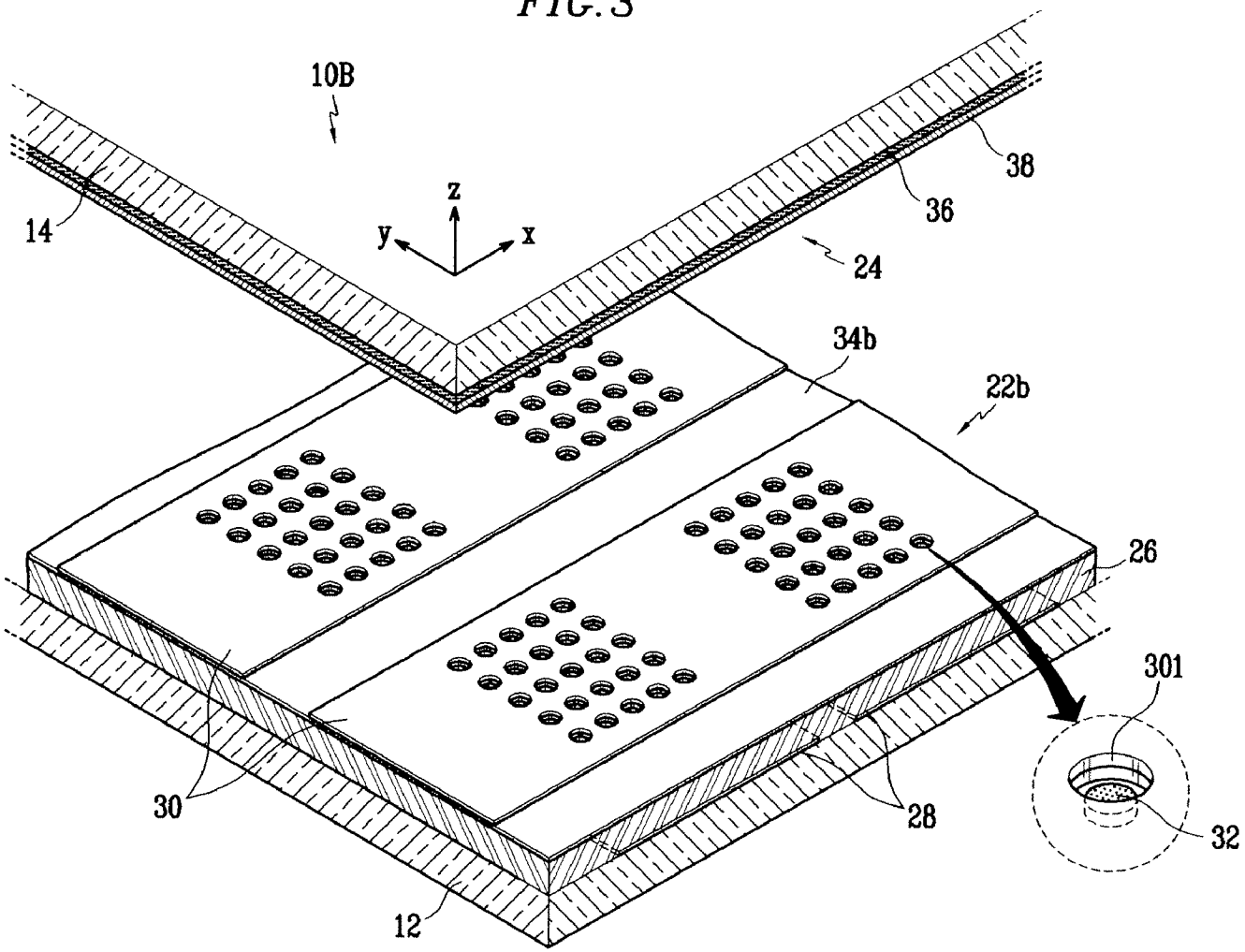
FIG. 3 is a partial exploded perspective view of an active area of a light emission device according to one embodiment of the present invention.

FIG. 3 is a partial exploded perspective view of an active area of a light emission device according to one embodiment of the present invention. Referring to FIG. 3, a light emission device 10B of this embodiment is similar to that of the embodiment of FIG. 1, except that a resistive layer 34*b* is formed on the entire top surface of the insulating layer 26. In this case, a patterning process for forming the resistive layer 34*b* can be omitted, thereby making the process for manufacturing the electron emission unit 22*b* simpler.

Figure 4:
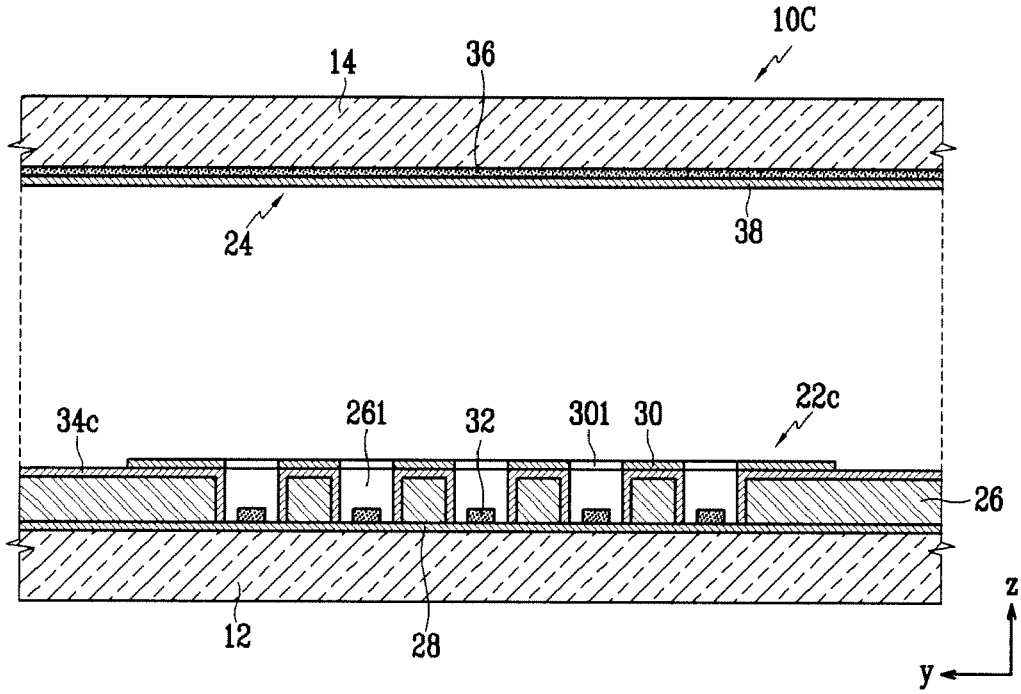
FIG. 4 is a partial enlarged sectional view of an active area of a light emission device according to one embodiment of the present invention.

FIG. 4 is a partial enlarged sectional view of an active area of a light emission device according to one embodiment of the present invention. Referring to FIG. 4, a light emission device 10C of this embodiment is similar to the embodiment of FIG. 3, except that a resistive layer 34*c* is formed on an entire top surface of the insulating layer 26 and sidewalls of openings 261.

According to this embodiment, even when the electrons emitted from the electron emission regions 32 collide with the sidewalls of the openings 261, the electric charges are not accumulated on the sidewalls of the openings 261, rather, they flow out to the external side through the resistive layer 34*c*. Therefore, the light emission device 10C of this embodiment can prevent the arcing by suppressing the accumulation of the electric charges on the sidewalls of the insulating layer openings 261 with which a relatively large amount of electrons collide.

Figure 5:
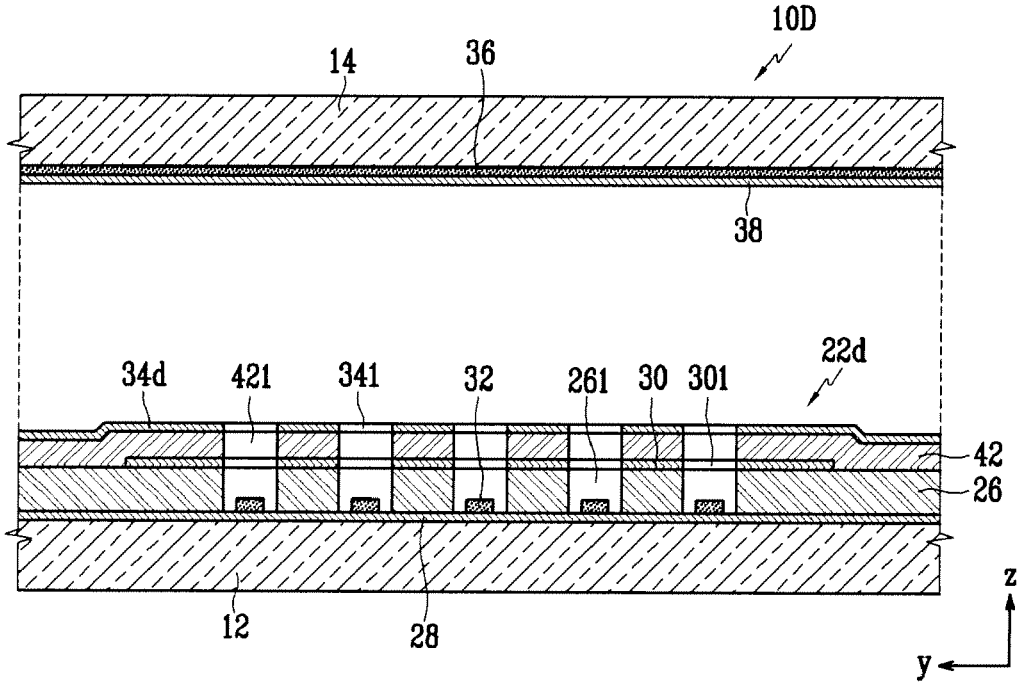
FIG. 5 is a partial enlarged sectional view of an active area of a light emission device according to one embodiment of the present invention.

FIG. 5 is a partial enlarged sectional view of an active area of a light emission device according to one embodiment of the present invention. Referring to FIG. 5, in a light emission device 10D of this embodiment, a resistive layer 34*d* is formed without directly contacting the insulating layer 26 and the second electrode 30.

That is, an additional insulating layer 42 is formed on the insulating layer 26 while covering the second electrodes 30 and the resistive layer 34*d* is formed on the additional insulating layer 42. At this point, openings 341 and 421 communicating with the openings 301 and 261 of the second electrodes 30 and the first insulating layer 26 are formed through the resistive layer 34*d* and the additional insulating layer 42.

In this embodiment, since the resistive layer 34*d* does not directly contact the second electrodes 30 by the additional insulating layer 42, it may be formed of a low specific resistance material having specific resistance within the range of about $10^2$-$10^4$ Ωcm. In one embodiment, a conductive layer may be formed instead of the resistive layer 34*d*.

The resistive layer 34*d* has an electric charge preventing function for suppressing arcing. As the resistance of the resistive layer 43*d* is lowered, the effect of the anode electric field on the electron emission regions can be more effectively lowered. Therefore, in the light emission device 10D of this embodiment, the arcing and the diode emission due to the anode electric field can be effectively suppressed even when the anode voltage is above 10 kV.

Figure 6:
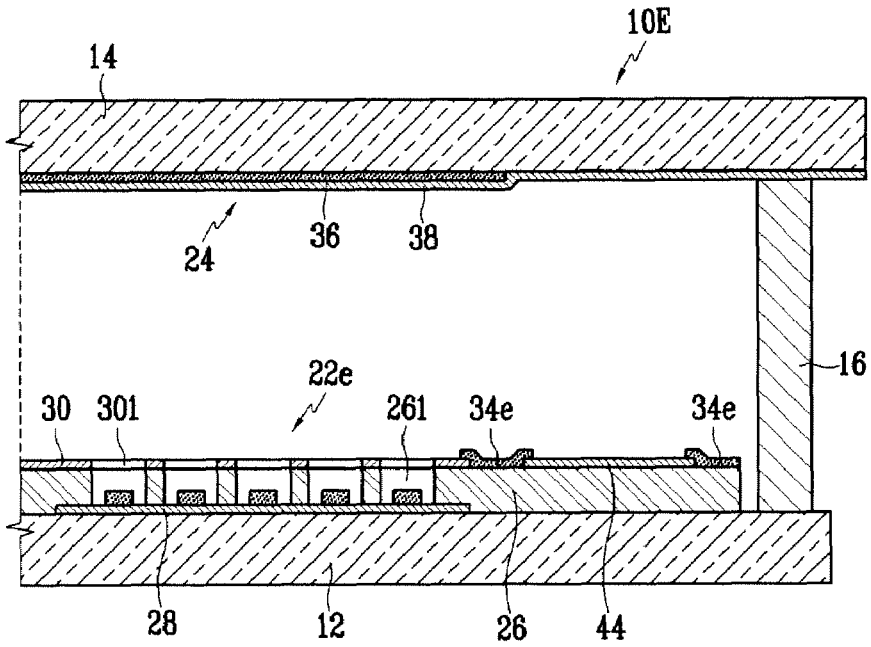
FIG. 6 is a partial enlarged sectional view of an active area of a light emission device according to one embodiment of the present invention.
Figure 7:
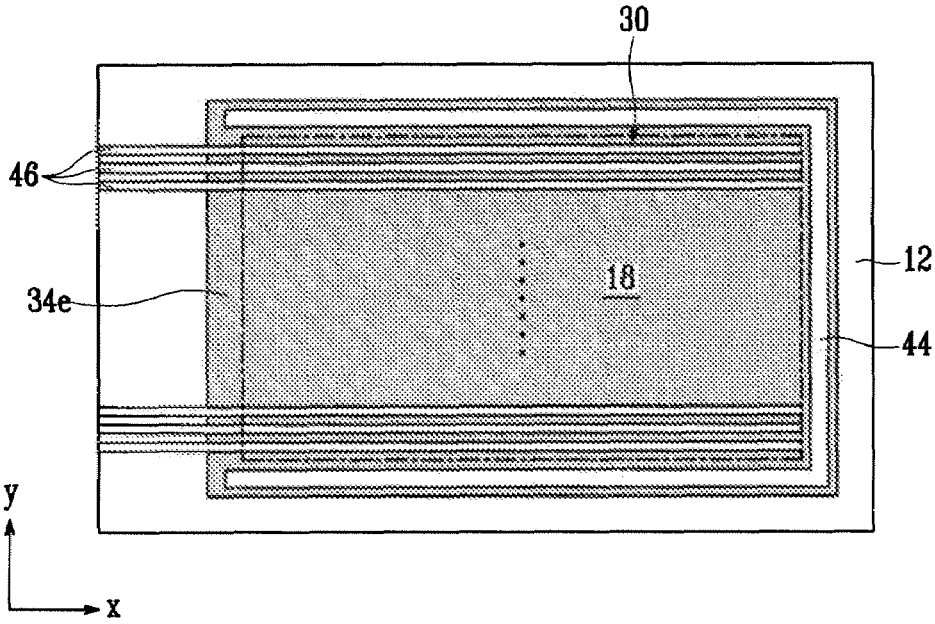
FIG. 7 is a top view of a first substrate and an electron emission unit of the light emission device of FIG. 6.

FIG. 6 is a partial enlarged sectional view of an active area of a light emission device according to one embodiment of the present invention and FIG. 7 is a top view of a first substrate and an electron emission unit of the light emission device of FIG. 6.

Referring to FIGS. 6 and 7, a light emission device 10E of this embodiment is similar of the embodiment of FIG. 1, except that a conductive layer 44 is formed on the inactive area of the insulating layer 26. The conductive layer 44 is spaced apart from the second electrodes 30 not to be electrically connected to the second electrodes 30. The conductive layer 44 is applied with a ground voltage through an external circuit.

The insulating layer 26 has two longitudinal side edges and two lateral side edges. The conductive layer 44 is formed on three side edges of the insulating layer 26, except for one side edge where second electrode leads 46 extending from the second electrodes 30 are formed. That is, the conductive layer 44 is formed on both longitudinal side edges and one lateral side edge of the insulating layer 26.

A resistive layer 34*e* is formed on an exposed portion of the insulating layer 26, which is not covered by the second electrodes 30 and the conductive layer 44 so that the exposed portion of the insulating layer 26 cannot be exposed to the vacuum. The resistive layer 34*e* continuously transmits electric charges accumulated on the surface of the insulating layer 26 to the conductive layer 44. The conductive layer 44 is grounded through an external circuit, therefore, the arcing can be effectively suppressed.

Figure 8:
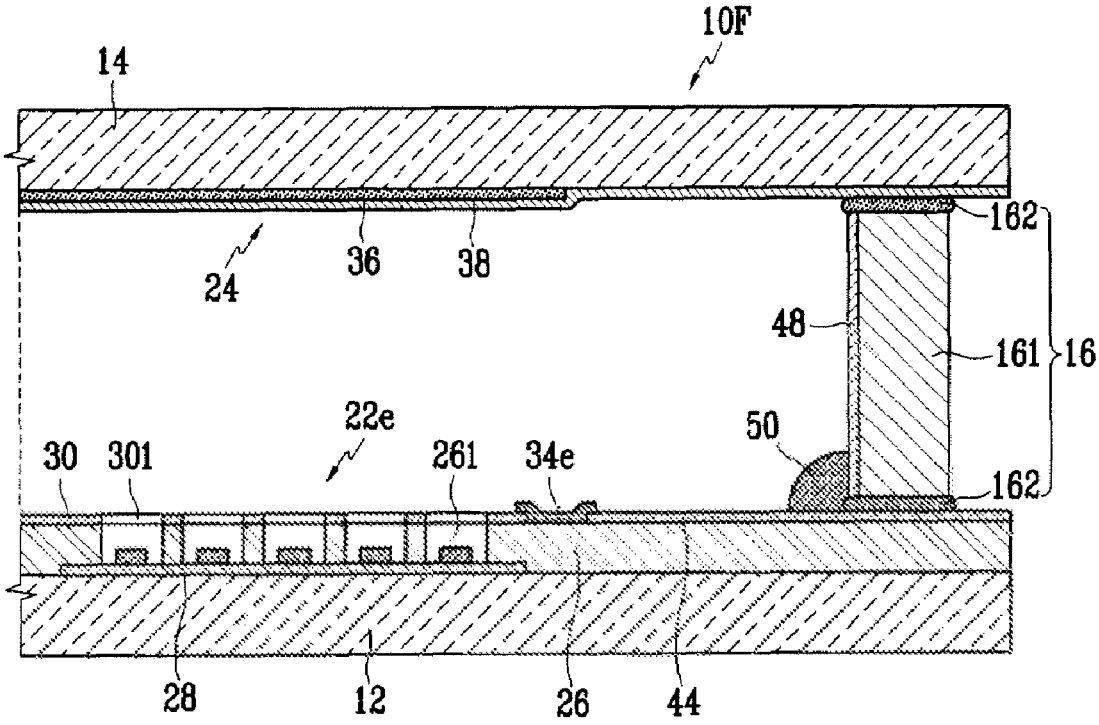
FIG. 8 is a partial enlarged sectional view of an active area of a light emission device according to one embodiment of the present invention.

FIG. 8 is a partial enlarged sectional view of an active area 18 of a light emission device according to one embodiment of the present invention. Referring to FIG. 8, a light emission device 10F may be based on any of the foregoing embodiments. However, the light emission device 10F has an additional resistive layer 48 (hereinafter, referred to as "second resistive layer") for suppressing the arcing, and is formed on an inner surface of the sealing member 16.

The sealing member 16 includes a support frame 161 formed of glass or ceramic and a pair of adhesive layers 162 respectively formed on a first surface of the support frame 161 facing the first substrate 12 and a second surface of the support frame 161 facing the second surface 14 to integrally adhere the first substrate 12, the support frame 161, and the second substrate 14 to each other. In this case, the second resistive layer 48 may be provided on an inner surface of the support frame 161.

The second resistive layer 48 may be electrically connected to the resistive layer provided on the first substrate 12 after the vacuum vessel is assembled, or to the conductive layer formed on the first substrate 12. That is, the second resistive layer 48 is grounded through the resistive layer provided on the first substrate 12, or the conductive layer provided on the first substrate. A negative DC voltage is applied to the second resistive layer 48 through the conductive layer.

In FIG. 8, the conductive layer 44 and the insulating layer 26 that are described in the embodiment of the FIGS. 6 and 7 extend out of the vacuum envelope. Also, the second resistive layer 48 is electrically connected to the conductive layer 44 through a conductive adhesive layer 50.

The second resistive layer 48 functions to suppress the arcing by preventing electric charges from accumulating on the inner surface of the sealing member 16. Particularly, when the negative DC voltage is applied to the second resistive layer 48, the second resistive layer 48 provides repulsive force to electrons that are emitted from the edge of the active area and spread widely, thereby guiding the electrons to the phosphor layer 36 of the corresponding pixel region. In this case, the light emission efficiency of the light emission device 10F is improved through the second resistive layer 48.

Figure 9:
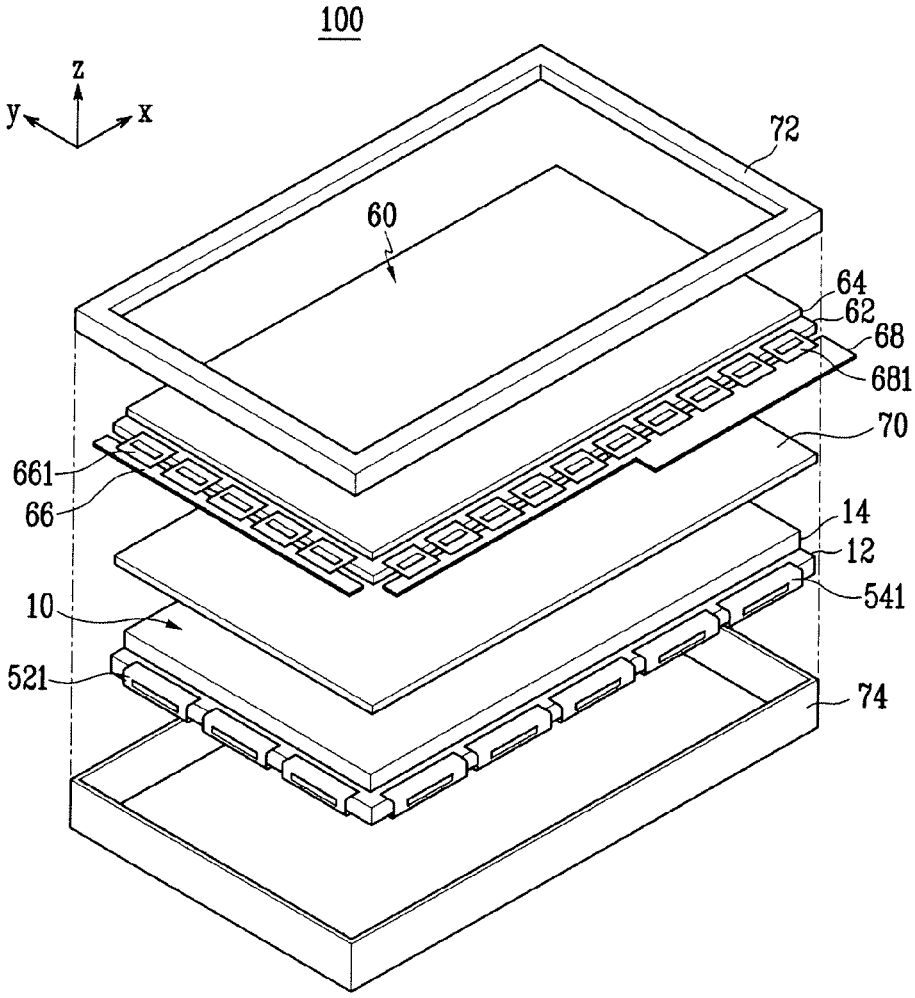
FIG. 9 is an exploded perspective view of a display device according to one embodiment of the present invention.

FIG. 9 is an exploded perspective view of a display device according to one embodiment of the present invention. The display device of FIG. 9 is exemplary only, and does not limit the present invention.

Referring to FIG. 9, a display device 100 of this embodiment includes a light emission device 10 and a display panel 60 disposed in front of the light emission device 10. A diffusion member 70 for uniformly diffusing the light emitted from the light emission device 10 toward the display panel 60 may be disposed between the display panel 60 and the light emission device 10. The diffusion member 70 may be spaced apart from the light emission device 10 by a predetermined distance. A top chassis 72 is disposed in front of the display panel 60 and a bottom chassis 74 is disposed at the rear of the light emission device 10.

The display panel 60 may be a liquid crystal display panel or any other non-self emissive display panel. In the following description, a liquid crystal display panel is exampled.

The display panel 60 includes a thin film transistor (TFT) substrate 62 comprised of a plurality of TFTs, a color filter substrate 64 disposed on the TFT substrate 62, and a liquid crystal layer (not shown) disposed between the TFT substrate 62 and the color filter substrate 64. Polarizer plates (not shown) are attached on a top surface of the color filter substrate 64 and a bottom surface of the TFT substrate 62 to polarize the light passing through the display panel 60.

The TFT substrate 62 is a glass substrate on which the TFTs and pixel electrodes are arranged in a matrix pattern. A data line is connected to a source terminal of one TFT and a gate line is connected to a gate terminal of the TFT. In addition, a pixel electrode is connected to a drain terminal of the TFT.

When electrical signals are input from circuit board assemblies 66 and 68 to the respective gate and data lines, electrical signals are input to the gate and source terminals of the TFT. Then, the TFT turns on or off according to the electrical signals input thereto, and outputs an electrical signal required for driving the pixel electrode to the drain terminal.

RGB color filters are formed on the color filter substrate 64 so as to emit predetermined colors as the light passes through the color filter substrate 64. A common electrode is deposited on an entire surface of the color filter substrate 64.

When electrical power is applied to the gate and source terminals of the TFTs to turn on the TFTs, an electric field is formed between the pixel electrode of the TFT substrate 62 and the common electrode of the color filter substrate 64. Due to the electric filed, the orientation of liquid crystal molecules of the liquid crystal layer can be varied, and thus the light transmissivity of each pixel can be varied according to the orientation of the liquid crystal molecules.

The circuit board assemblies 66 and 68 of the display panel 60 are connected to drive IC packages 661 and 681, respectively. In order to drive the display panel 60, the gate circuit board assembly 66 transmits a gate drive signal and the data circuit board assembly 68 transmits a data drive signal.

The number of pixels of the light emission device 10 is less than that of the display panel 60 so that one pixel of the light emission device 10 corresponds to two or more pixels of the display panel 60. Each pixel of the light emission device 10 emits light in response to the highest gray value among the corresponding pixels of the display panel 60. The light emission device 10 can represent 2-8 bits gray value at each pixel.

For convenience, the pixels of the display panel 60 will be referred to as first pixels and the pixels of the light emission device 10 will be referred to as second pixels. In addition, a plurality of first pixels corresponding to one second pixel will be referred to as a first pixel group.

In order to drive the light emission device 10, a signal control unit (not shown) for controlling the display panel 60 detects a highest gray value among the first pixels of the first pixel group, calculates a gray value required for the light emission of the second pixel according to the detected gray value, converts the calculated gray value into digital data, and generates a driving signal of the light emission device 10 using the digital data. The drive signal of the light emission device 10 includes a scan drive signal and a data drive signal.

Circuit board assemblies (not shown), that is a scan circuit board assembly and a data circuit board assembly, of the light emission device 10 are connected to drive IC packages 521 and 541, respectively. In order to drive the light emission device 10, the scan circuit board assembly transmits a scan drive signal and the data circuit board assembly transmits a data drive signal. One of the first and second electrodes receives the scan drive signal and the other receives the data drive signal.

Therefore, when an image is to be displayed by the first pixel group, the corresponding second pixel of the light emission device 10 is synchronized with the first pixel group to emit light with a predetermined gray value. The light emission device 10 has pixels arranged in rows and columns. The number of pixels arranged in each row may be 2 through 99 and the number of pixels arranged in each column may be 2 through 99.

As described above, in the light emission device 10, the light emission intensities of the pixels of the light emission device 10 are independently controlled to emit a proper intensity of light to each first pixel group of the display panel 60. As a result, the display device 100 of the present invention enhances the dynamic contrast of the screen.

Although exemplary embodiments of the present invention have been described in detail hereinabove, it should be clearly understood that many variations and/or modifications of the basic inventive concept taught herein still fall within the spirit and scope of the present invention, as defined by the appended claims.

What is claimed is:

1. A light emission device comprising:

a vacuum envelope formed by first and second substrates and a sealing member;

first electrodes on the first substrate in a first direction;

an insulating layer on the first substrate and covering the first electrodes;

second electrodes on a portion of the insulating layer in a second direction crossing the first direction;

electron emission regions electrically connected to one of the first and second electrodes;

a resistive layer for covering a first surface of the insulating layer, the first surface facing the second substrate, wherein the resistive layer electrically contacts the second electrodes;

a phosphor layer on the second substrate; and an anode electrode on the phosphor layer.

2. The light emission device of claim 1, wherein the resistive layer is on a first portion of the first surface of the insulating layer, the first portion excluding the second electrodes.

3. The light emission device of claim 1, wherein the resistive layer covers the entire first surface of the insulating layer.

4. The light emission device of claim 3, wherein openings are through the second electrodes and the insulating layer at overlapping regions of the first and second electrodes; the electron emission regions are on the first electrodes through the openings; and the resistive layer is on sidewalls of the openings of the insulating layer.

5. The light emission device of claim 1, further comprising a second resistive layer on an inner surface of the sealing member.

6. The light emission device of claim 1, wherein the resistive layer has a resistance substantially within a range of $10^6$-$10^{12}$ Ωcm.

7. The light emission device of claim 1, wherein a ground voltage or a negative DC voltage is applied to the resistive layer.

8. The light emission device of claim 1, wherein the resistive layer is above the insulating layer and the second electrodes with a second insulating layer disposed therebetween and openings through which electron beams pass through the second insulating layer.

9. The light emission device of claim 8, wherein the resistive layer has a resistance substantially within a range of $10^6$-$10^{12}$ Ωcm.

10. The light emission device of claim 1, wherein the electron emission regions are a material including at least one of a carbon-based material and a nanometer-sized material.

11. The light emission device of claim 1, wherein the first and second substrates are spaced apart from each other by a distance substantially within a range of 5-10 mm and the light emission device further comprises an anode voltage applying unit applying a direct current voltage substantially within a range of 10-15 kV to the anode electrode.

12. A light emission device comprising:

a vacuum envelope formed by first and second substrates and a sealing member;

first electrodes on the first substrate in a first direction;

an insulating layer on the first substrate and covering the first electrodes;

second electrodes on a portion of the insulating layer in a second direction crossing the first direction;

electron emission regions electrically connected to one of the first and second electrodes;

a resistive layer for covering a first surface of the insulating layer, the first surface facing the second substrate;

a phosphor layer on the second substrate;

an anode electrode on the phosphor layer; and a conductive layer on an edge of the insulating layer and spaced away from the second electrodes, wherein the resistive layer is on a first portion of the insulating layer, the first portion of the insulating layer facing the second substrate and excluding the second electrodes and the conductive layer.

13. The light emission device of claim 12, further comprising a second resistive layer on an inner surface of the sealing member, wherein the second resistive layer is electrically connected to the conductive layer through a conductive adhesive layer.

14. A display device comprising:

a display panel for displaying an image;

a light emission device for emitting light toward the display panel, wherein the light emission device comprises:

a vacuum envelope formed by first and second substrates and a sealing member;

an electron emission unit including first electrodes on the first substrate in a first direction, an insulating layer on the first substrate and covering the first electrodes, second electrodes on a portion of the insulating layer in a second direction crossing the first direction, electron emission regions electrically connected to one of the first and second electrodes, and a resistive layer for covering a first surface of the insulating layer, the first surface facing the second substrate, wherein the resistive layer electrically contacts the second electrodes; and a light emission unit including a phosphor layer on the second substrate and an anode electrode on the phosphor layer.

15. The display device of claim 14, wherein the resistive layer is on a first portion of the first surface of the insulating layer, the first portion excluding the second electrodes.

16. The display device of claim 14, wherein the resistive layer covers the entire first surface of the insulating layer.

17. The display device of claim 14, further comprising a second resistive layer on an inner surface of the sealing member.

18. The display device of claim 14, wherein the resistive layer has a resistance substantially within a range of about $10^6$-$10^{12}$ Ωcm.

19. The display device of claim 14, wherein the resistive layer is above the insulating layer and the second electrodes with a second insulating layer disposed therebetween and openings through which electron beams pass through the resistive layer and the second insulating layer.

20. The display device of claim 14, wherein the display panel includes first pixels and the light emission device includes second pixels, wherein the number of the second pixels is less than that of the first pixels and light emission intensities of the second pixels are independently controlled.

21. The display device of claim 14, wherein the display panel is a liquid crystal display panel.

22. A display device comprising:

a display panel for displaying an image;

a light emission device for emitting light toward the display panel, wherein the light emission device comprises:

a vacuum envelope formed by first and second substrates and a sealing member;

an electron emission unit including first electrodes on the first substrate in a first direction, an insulating layer on the first substrate and covering the first electrodes, second electrodes on a portion of the insulating layer in a second direction crossing the first direction, electron emission regions electrically connected to one of the first and second electrodes, and a resistive layer for covering a first surface of the insulating layer, the first surface facing the second substrate;

a light emission unit including a phosphor layer on the second substrate and an anode electrode on the phosphor layer; and a conductive layer on an edge of the insulating layer and spaced away from the second electrodes, wherein the resistive layer is on a first portion of the insulating layer, the first portion of the insulating layer facing the second substrate and excluding the second electrodes and the conductive layer.

* * * * *